United States Patent [19]

Primont et al.

[11] 4,316,181

[45] Feb. 16, 1982

[54] THEFT PREVENTION SYSTEM FOR BUSINESS MACHINES

[76] Inventors: James Primont, 205 Ramapo Ave., Staten Island, N.Y. 10309; Joseph Williams, 11 Greencroft Ave., Staten Island, N.Y. 10308; Paul Zazzera, Jr., 641-90th St., Brooklyn, N.Y. 11228

[21] Appl. No.: 207,454

[22] Filed: Nov. 17, 1980

[51] Int. Cl.[3] ..... G08B 13/14

[52] U.S. Cl. ..... 340/571; 200/42 R; 200/85 R; 340/666; 340/693

[58] Field of Search ..... 340/571, 666, 693; 200/42 R, 85 R

[56] References Cited

U.S. PATENT DOCUMENTS

| | | | |
|---|---|---|---|
| 2,928,336 | 3/1960 | Jagger | 116/99 |
| 3,685,037 | 8/1972 | Bennett et al. | 340/571 |
| 3,815,117 | 6/1974 | Gopperton | 340/571 |
| 4,092,641 | 5/1978 | Bellinghausen et al. | 340/571 |
| 4,274,088 | 6/1981 | Pierson et al. | 340/666 |

*Primary Examiner*—Glen R. Swann, III
*Attorney, Agent, or Firm*—Anthony J. Casella

[57] ABSTRACT

A theft prevention system for use with business machines having a housing, including a base and a removable cover includes an alarm, which is connected to a microswitch having a spring biased plunger that projects downwardly, through an aperture formed in the base of the housing, and abuts the surface upon which the machine rests. The microswitch is positioned such that when the machine is lifted from the resting surface, the plunger is biased into an active position thereby actuating the alarm. A protective sleeve which is fixedly connected to the resting surface surrounds the plunger and extends upwardly into the housing through the associated aperture thereby inhibiting tampering with the microswitch. A second microswitch may be provided which includes a spring biased member that is disposed in abutting relationship with the cover of the housing and functions to actuate the alarm when an attempt is made to separate the cover from the base. The subject invention further includes an improved locking bracket for releasably securing the cover to the base. The improved locking bracket prevents the removal of the cover from the base unless the machine is lifted from the resting surface, which actuates the first microswitch thereby sounding the alarm.

14 Claims, 4 Drawing Figures

THEFT PREVENTION SYSTEM FOR BUSINESS MACHINES

BACKGROUND OF THE INVENTION

The subject invention relates to an improved theft prevention system for use with a business machine such as a typewriter.

The unauthorized taking of business machines, from office settings and the like, has always been a problem due to their portable nature which facilitates rapid pilferage. Today, as the sophistication and cost of business machines escalate, a concomitant rise in the number of thefts has been observed. Research has shown that a large majority of these thefts occur during business hours when offices are understaffed, such as at opening or closing time, as well as at lunchtime. Accordingly, a number of devices have been developed, for reducing the number of machines which are removed without authorization. One type of prior art device functions to sound an alarm when the machine is moved from its resting place. This type of device is effective in reducing business hour crime since the alarm alerts any office personnel, in the general area, to the presence of the thief.

One example of this type of prior art device can be found in U.S. Pat. No. 2,928,336, issued Mar. 15, 1960, to Jagger. The device disclosed in Jagger, which is intended to be housed within a check writing device, includes a switch having a spring biased plunger mechanism which extends downwardly from the base of the device into abutting contact with a planar surface or desk. When the machine is lifted from the desk, the plunger is biased into an active position thereby sounding an alarm. One problem of the Jagger device is that the switch may be tampered with easily thereby disarming the alarm. For example, simply by sliding a thin piece of flexible material under the plunger prior to lifting the machine, a thief is able to prevent the plunger from moving into the active position thereby preventing the alarm from sounding.

One means for overcoming the latter shortcoming may be found in U.S. Pat. No. 3,815,117, issued June 4, 1974 to Gopperton. The latter patent discloses a two way switch, associated with a plunger mechanism. The switch includes an extra contact, above the plunger, such that an alarm will be sounded in response to any movement of the plunger. Thus, the alarm will sound if the machine is raised from the table permitting the plunger to move downwardly. In addition, if a thief attempts to disarm the device by sliding a thin strip underneath the plunger, the resulting upward movement of the plunger will close the extra contact in the switch thereby sounding the alarm. The device disclosed in Gopperton, while providing increased security, requires a relatively complex and costly switch and plunger mechanism. In addition, a skillful and knowledgeable burglar can still disarm the device by totally arresting the movement of the plunger.

Another shortcoming of the prior art devices is that a thief gaining access to the interior of the machine, can rapidly halt the sounding of the alarm thereby decreasing the likelihood of detection. More specifically, while certain machines provide a relatively solid enclosure, a business machine, such as a typewriter, having a removable cover structure, facilitates access to the interior of the machine permitting rapid mechanical dismantling of the alarm.

Accordingly, it is an object of the subject invention to provide a new and improved theft prevention system for use with a business machine which includes a unique guard means, for shielding the plunger mechanism of a switch means, thereby inhibiting any unauthorized tampering with the plunger.

It is another object of the subject invention to provide a theft prevention system for a business machine which includes an elongated protective sleeve that is fixedly connected to a planar resting surface and extends upwardly into the housing of the machine surrounding the plunger mechanism thereby preventing access thereto.

It is a further object of the subject invention to provide a theft prevention system for a business machine which includes an additional switch means that is actuated by relative movement between the base and the cover of the housing thereby increasing the chances of detecting any unauthorized tampering with the machine.

It is still another object of the subject invention to provide a new and improved theft prevention system for business machines which includes a unique locking bracket for releasably securing the cover to the base. The locking bracket is connected to the base by a screw which can be disengaged only when the machine is first upwardly lifted from its resting place thereby actuating an alarm.

SUMMARY OF THE INVENTION

In accordance with these and many other objects, the subject invention provides for a new and improved theft prevention system for use with a business machine having a housing including a base and a removable cover. The subject invention includes an electrical microswitch having a spring biased plunger mechanism. The microswitch is located within the housing such that the plunger projects downwardly through an aperture provided in the base, and into abutting contact with a planar surface, such as a desk, upon which the machine rests. The planar resting surface functions to maintain the plunger in a retracted, upward, inactive position, until the machine is lifted from the table enabling the plunger to be biased downwardly into an active position thereby actuating an alarm located within the housing. Preferably, the alarm generates an audio warning signal in response to the signal from the switch.

In accordance with the subject invention, a unique guard means is provided to inhibit tampering with plunger mechanism of the microswitch. More specifically, an elongated cylindrical protective sleeve, which is fixedly connected to the planar resting surface, projects upwardly into the housing of the machine, through the aperture provided in the base. The protective sleeve surrounds the plunger mechanism of the switch thereby preventing a thief from manipulating or otherwise affecting the motion of the plunger.

As stated above, one shortcoming associated with prior art alarm devices, is that the system can be deactivated if a thief gains undetected access to the interior of the housing. In order to overcome this shortcoming, the subject invention includes a second microswitch having a spring biased member which is in abutting contact with the upper surface of the cover of the housing. The downward pressure exerted by the cover maintains the spring biased member in an inactive orientation. However, if an attempt to gain access to the interior of the housing is made by removing the cover from the base, the spring biased member will shift into an active position. The movement of the member actuates the second microswitch thereby sounding the alarm, alerting office personnel to the presence of a thief.

While the second microswitch will cause an alarm to sound if an attempt is made to break into the housing of the machine, a thief will nevertheless be ultimately successful if he can quickly dismantle the alarm before it can attract attention to his maneuvers. Therefore, in a preferred embodiment of the subject invention, a new and improved locking bracket is provided which cooperates with the first microswitch to effectively increase the length of time the alarm sounds thereby increasing the likelihood of detection. More specifically, at least one longitudinally extending bracket is affixed at one end thereof, to the cover of the housing, while the other end is releasably secured to the base. The releasable connection includes a screw which projects into the housing through an aperture provided in the latter and is threadably engaged with the bracket. In accordance with the subject invention, the length of the screw is greater than the spacing between the screw head and the planar resting surface such that the screw cannot be fully disengaged from the bracket without raising the machine from the desk, thereby actuating the first microswitch and sounding the alarm. Stated differently, in order to gain access to the interior of the housing, a thief must attempt to remove the screw holding the locking bracket in place. However, the length of the screw prevents its disengagement from the bracket while the machine rests on the desk. Therefore, the thief must initially raise the machine from the table, thereby setting off the alarm, and thereafter remove the screw and the cover to permit deactivation of the system. Thus, the locking bracket cooperates with the first microswitch to increase the length of time it takes for even a skilled thief to deactivate a ringing alarm, thereby increasing the likelihood of detection.

Other objects and advantages of the subject invention will become apparent from the following detailed description taken in conjunction with the drawings in which:

DETAILED DESCRIPTION OF THE PREFERRED EMBODIMENT

Figure 1:
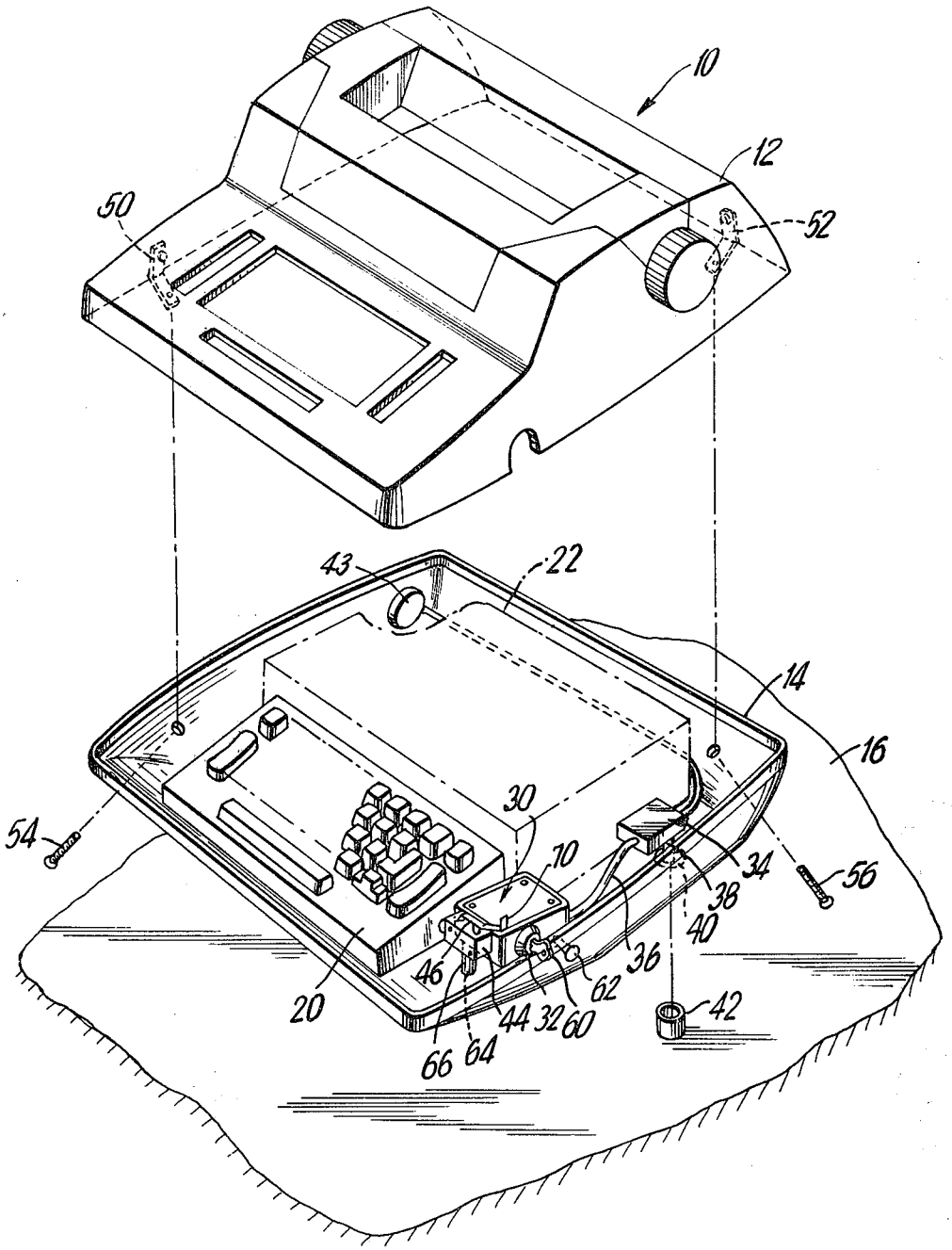
FIG. 1 is an exploded perspective view of a typewriter having the new and improved theft prevention system of the subject invention installed therein.
Figure 3:
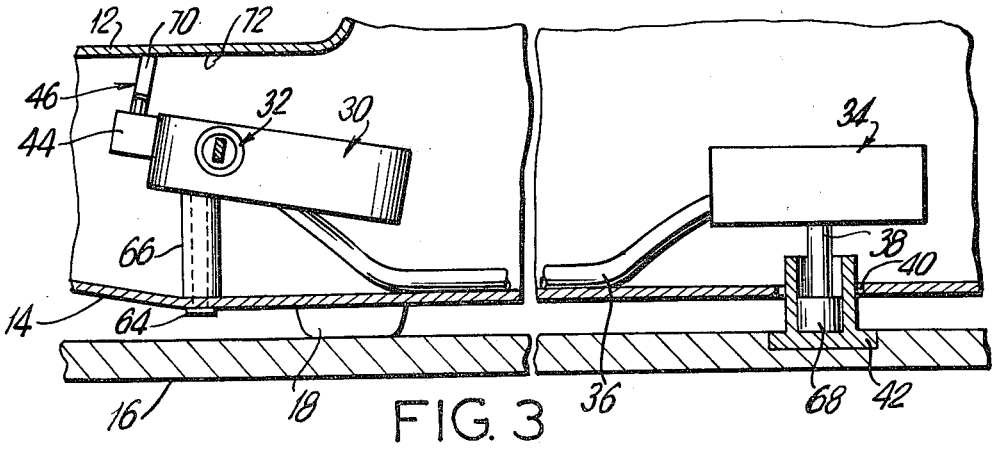
FIG. 3 is a partial cross sectional view, taken along the line 3—3 of FIG. 2, illustrating the alarm means, as well as the first and second microswitches of the new and improved theft prevention system of the subject invention.

Referring to FIG. 1, there is illustrated an exploded view of a typewriter 10 having a cover 12 and a base 14. The base 14 is intended to rest on a planar surface 16 such as a desk and is usually provided with plastic or rubber rest pads 18, as illustrated in FIG. 3. Typewriter 10 further includes a keyboard 20 and a key and carriage area 22 (shown in phantom). It is understood that while the subject invention is shown used in conjunction with a typewriter, it is intended that the scope of the subject invention include its use with any suitable business machine.

Briefly, the theft prevention system of the subject invention includes an electrically actuated alarm circuit 30 which is mounted to the base 14 and includes a lock means 32 for selectively disabling the alarm. A first microswitch 34 is provided which is connected to the alarm 30, via wire 36. Microswitch 34 includes a plunger 38 which projects downwardly through an aperture 40 provided in the base of the housing 14. In accordance with the subject invention, a shield member 42 is affixed to the desk 16 for protecting plunger 38 of microswitch 34. Preferably, a sounding device 43 may be provided, connected to the alarm circuit 30 to produce an audible warning signal. A second microswitch 44 is provided having a spring biased member which is disposed in abutting relationship with the inner upper surface of the cover 12 of the housing, as illustrated in FIG. 3. The subject invention further includes a pair of locking brackets 50, 52 which are each fixedly connected, at one end thereof, to the cover. The other end of each locking bracket is releasably connected to the base 14 via screws 54, 56, respectively. The length of the screws, as well as their angle relative to the base 14, and the desk 16, prevents their removal without first lifting the typewriter 10 off the desk, as more fully described hereinafter.

As illustrated in FIG. 1, alarm circuit 30, which is contained in a generally rectangular housing, includes circuitry and a power source capable of generating an electronic signal which is convertible to an audible alarm through sounder 43 for alerting office personnel to the presence of a thief. Preferably, the circuitry, which is of a type well known in the art, generates a continuous signal, from the time it is actuated, until is is disarmed via the lock means 32. Lock means 32, as illustrated in FIG. 1, consists of a lock and key 60 which is capable of selectively arming and disarming the alarm 30. More specifically, key 60 is used to initially set lock means 32 in an active position, and then is removed and held by a trusted employee or security personnel. If the alarm 30 is actuated due to unauthorized movement of the machine, it can only be shut off by inserting the key 60 and turning lock means 32. Of course, if the machine needs to be serviced, or otherwise handled, the alarm would first be deactivated by key 60. Alarm 30 is mounted to base 14 via bolts 62 and 64. A spacer 66 is inserted around bolt 64 in order to raise the forward end of the alarm housing thereby moving spring biased member 46 of microswitch 44 into abutting contact with the upper inner surface of the cover 12, as more fully described hereinafter.

First microswitch 34, which is mounted on housing 14 is connected to alarm 30 by wire 36. Microswitch 34 includes a spring biased plunger 38 which is preferably provided with an enlarged cap portion 68, as illustrated in FIG. 3. Microswitch 34 is of conventional design, and includes a circuit path which is in the off or inactive mode when the plunger 38 is pushed upwardly, into a retracted position. Microswitch 34 includes a spring means (not shown) which tends to bias the plunger into a downward, extended position corresponding to the on or active position for sounding the alarm. Microswitch 34 is positioned such that plunger 38 extends downwardly through aperture 40 provided in base 14, and into abutting contact with desk 16. In accordance with the subject invention, the length of plunger 34 is such that desk 16 causes the plunger to be biased upwardly into the retracted inactive position. However, if the typewriter 10 is lifted from the table 16, the internal spring of microswitch 34 will bias the plunger downwardly into the active position, thereby completing the circuit and causing the alarm to sound.

As pointed out above, this type of plunger mechanism can be defeated by sliding a thin strip of material underneath the cap 68 of plunger 38 and thereafter holding the plunger in the retracted, inactive position as the typewriter is lifted from the desk and stolen. Therefore, in order to overcome this shortcoming, the subject invention includes a protective sleeve 42 which surrounds the plunger and prevents the unauthorized tampering therewith. More specifically, and as illustrated in FIG. 3, sleeve 42, which is generally cylindrical in configuration, is permanently mounted on the upper surface of table 16 by any suitable means. Sleeve 42 projects upwardly and extends into the housing of the machine 10 through aperture 40, thereby surrounding plunger 38. By this arrangement, the deactivization of the alarm by manipulation of the plunger 38 is prevented. Therefore, when the typewriter is lifted from the desk 16, the plunger will be biased into its extended, active position, before it clears the protective sleeve 42, thereby sounding the alarm.

While the above described microswitch 34, in combination with the protective sleeve 42 improves the alarm system over the prior art, a thief may attempt to foil the device by disabling the alarm directly. More specifically, a thief may attempt to remove the cover 12 of the typewriter, and quickly dismantle or destroy the alarm 30. Accordingly, the subject invention further includes a second microswitch 44 which is preferably fixedly connected to the alarm housing 30. Second microswitch 44 includes a spring biased member 46, which has a vertically upstanding end portion 70. As illustrated in FIG. 3, second microswitch 44 is located such that the upstanding portion 70 of member 46 is in abutting contact with the upper inner surface 72 of the cover 12 of the typewriter 10. As noted above, spacer 66, which surrounds mounting bolt 64, supports and raises alarm 30 such that member 46 of microswitch 44 abuts the cover 12. Similar to microswitch 34, member 46 is biased into its retracted, inactive position by the inner surface 72 of cover 12. However, any tampering with the cover 12, which increases the spatial distance between the cover 12 and the base 14, permits member 46 to be biased into an extended active position, thereby activating alarm 30. Thus, in use, if a thief attempts to remove the cover 12 to disable the alarm, the initial shifting of the cover immediately activates the alarm thereby signaling the presence of the thief. Preferably, the stroke of the second microswitch 44 is relatively short, such that the switch will be highly sensitive to any unauthorized manipulation.

Figure 4:
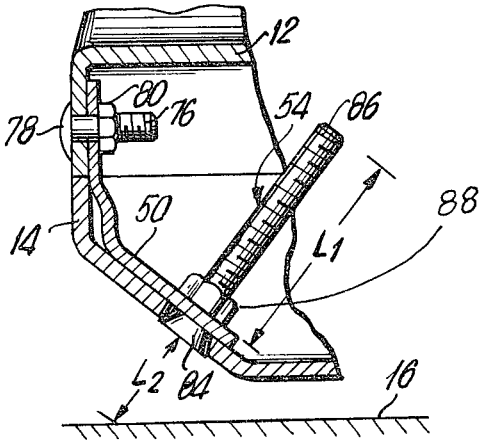
FIG. 4 is a partial cross sectional view, taken along the line 4—4 of FIG. 2, illustrating one of the locking brackets of the theft prevention system of the subject invention.

As noted above, it has been found that a large majority of thefts occur during business hours when offices are understaffed. Thus, any given office may be empty for a short time during which a burglar may risk sounding an alarm for a brief period. More specifically, a thief may attempt to remove the cover 12 from the base 14, thereby sounding the alarm, and thereafter dismantle or destroy the alarm as quickly as possible and before the attention of office personnel has been attracted. Since the removal of the cover of a machine such as an office typewriter is relatively simple and quick, it is a further object of the subject invention to provide an improved means for releasably securing the cover 12 to the base, which will substantially increase the time between the initial tampering with the machine (thereby sounding the alarm) and the disabling of the alarm. More specifically, and as illustrated in FIG. 4, at least one locking bracket 50, is provided which is fixedly secured, at one end thereof, to the cover 12. Preferably, the fixed connection includes a lag bolt 76, having a flat head portion 78. The lag bolt 76 passes through aligned apertures in the cover 12 and bracket 50 and is secured by a nut 80. The flattened head portion 78 of the lag bolt 76 prevents the loosening or removal of the bolt from the outside of the machine.

The opposed end of the locking bracket 50 is releasably connected to the base 14 of the housing by a longitudinally extending screw 54, having a head portion 84 and a threaded portion 86. Screw 54 is installed through aligned apertures in the base and bracket, and is affixed by nut 88. Preferably, nut 88 is fixedly secured to bracket 50 by brazing or other suitable means. The head portion 84 of screw 54 includes a driving recess such as a hex indentation, to permit the tightening or disengagement of the screw via a suitable driver.

In accordance with the subject invention, the length and orientation of the screw 54 is such that it cannot be totally disengaged from nut 88 (thereby allowing the separation of the cover 12 from the base 14) without first raising the typewriter from the desk which would trigger the alarm via microswitch 34. More specifically, the locking means of the subject invention is arranged such that the length L1 of the threaded portion 86 of screw 54 is greater than a length L2, which corresponds to the spacing between the head 84 of the screw 54 and the upper surface of the desk 16, measured along the longitudinal axis of the screw. Of course, since the screw must be disengaged in a direction along its longitudinal axis, it is impossible to fully disengage the screw from the locking bracket 50 while the typewriter 10 is resting on the desk. Accordingly, if a thief attempts to remove the cover 12, he must initially raise the typewriter off the desk thereby tripping first microswitch 34 and activating alarm 30. Only after the screw 54 is removed may the thief separate the cover 12 from the base 14 in order to begin disabling the alarm.

Figure 2:
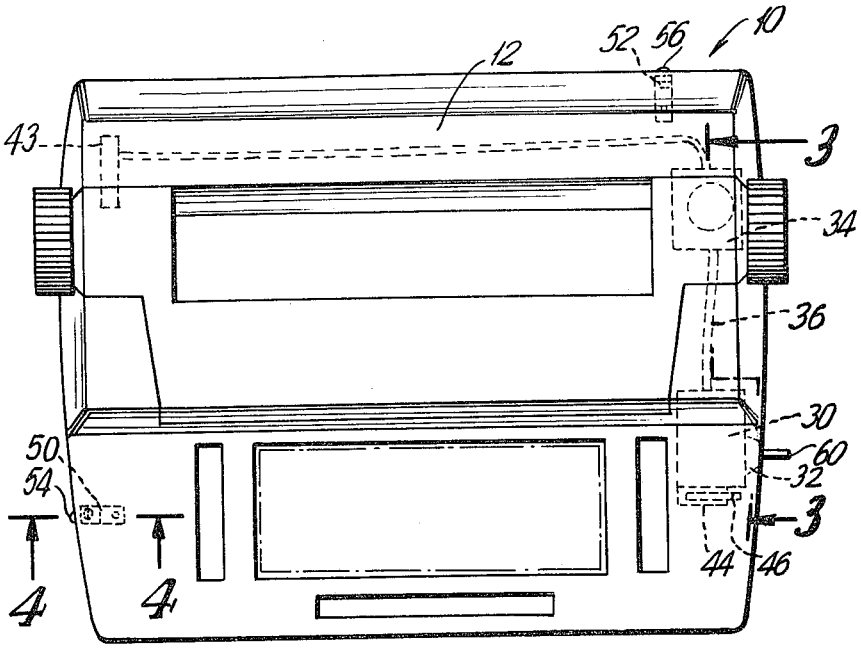
FIG. 2 is a top plan view of a typewriter, illustrating the placement therein of the new and improved theft prevention system of the subject invention, shown in phantom, with portions of the typewriter removed for clarity.

Preferably, two locking brackets 50 and 52, as illustrated in FIG. 2, are provided such that the length of time between the initial tampering with the typewriter and the thief's eventual disabling of the alarm is maximized whereby the likelihood of detection is substantially increased. Second locking bracket 52 is mounted similarly to first locking bracket 50 and therefore need not be further described.

The lower end of locking bracking 50 may, of course, be extended further and into parallel relationship with the base 14 and desk 16. While this arrangement places the screw head 84 directly beneath the base 14, the screw could still be removed with an angled driver, without lifting the machine from the desk, unless the length L1 of the threaded portion 86 is greater than the spacing L2 between the screw head 84 and the desk, measured along the longitudinal axis of the screw, in accordance with the subject invention.

In summary, there is provided a new and improved theft prevention system for use with business machines having a housing which includes a base and a removable cover. The subject system includes an alarm 30 and sounder 43 which is connected to a first microswitch 34 having a plunger 38 that projects downwardly through an aperture 40 in the base of the housing into abutting contact with a supporting surface 16. The supporting surface functions to bias the plunger into a retracted inactive position such that if the machine is lifted upwardly therefrom, the plunger is biased into an extended, active position, thereby triggering the alarm. A generally cylindrical shield member 42 is provided, which is fixedly connected to the desk and extends upwardly into the aperture of the base and surrounds the plunger of the microswitch. By this arrangement, manipulation of the plunger in order to disable the alarm is inhibited. The subject invention further includes a second microswitch 44 having a spring biased member 46 disposed in abutting relationship with the cover of the housing, such that when the cover is shifted relative to the base, the alarm will be triggered. An improved locking means is also disclosed including a locking bracket having one end thereof fixedly connected to the cover. The other end of the bracket is releasably secured to the base by a screw. The length and location of the screw is such that the screw cannot be fully disengaged from the bracket unless the machine is lifted from the table thereby triggering the first microswitch sounding the alarm.

Although the subject invention has been described by reference to a preferred embodiment, it is apparent that other modifications could be devised by those skilled in the art that would fall within the scope and spirit of the present invention as defined by the appended claims. For example, it may be desirable to have the alarm connected to a central switching area enabling the system to be monitored by security personnel. By this arrangement, should the alarm means within the housing be triggered, its signal would be directly routed to a central control area thereby increasing the likelihood of early detection.

What is claimed is:

1. A theft prevention system for use with a business machine, said business machine having a housing including a base, adapted to rest on a planar surface, and a removable cover, and wherein said base includes an aperture, said theft prevention system comprising:

alarm means disposed within said housing, said alarm means being capable of generating a warning signal;

first switch means operatively connected to said alarm means and including a spring biased plunger, said first switch means being disposed such that said plunger projects downwardly through said aperture provided in the base of said housing, said plunger being in abutting contact with said planar resting surface such that said plunger is biased into an upward inactive position whereby when said housing is lifted upwardly from said planar surface, said plunger is biased downwardly actuating said alarm means thereby generating a warning signal; and guard means associated with said first switch means, said guard means including an elongated protective sleeve with one distal end thereof fixedly connected to said planar surface and with the other distal end thereof projecting upwardly into said aperture of said base and surrounding said plunger whereby said plunger is shielded from manipulation.

2. A theft prevention system as recited in claim 1 wherein said protective sleeve is generally cylindrical in configuration.

3. A theft prevention system as recited in claim 1 further including a second switch means operatively connected to said alarm means and affixed to said base, said second switch means including a spring biased member disposed in abutting contact with the upper inner surface of said cover thereby maintaining said spring biased member in an inactive position whereby when said cover is moved upwardly relative to said base, said spring biased member is biased upwardly actuating said alarm means thereby generating a warning signal.

4. A theft prevention system as recited in claim 3 wherein said alarm means is fixedly connected to said base and said second switch means is fixedly connected to said alarm means.

5. A theft prevention system as recited in claim 3 wherein said first and second switch means are electrical microswitches.

6. A theft prevention system as recited in claim 1 further including a control means operatively connected to said alarm means, said control means for selectively disabling said alarm means.

7. A theft prevention system as recited in claim 6 wherein said control means includes a lock and key combination, said key for moving said lock from an active to an inactive position thereby selectively disabling said alarm means.

8. A theft prevention system as recited in claim 1 wherein said alarm means includes a sounder for generating an audible warning signal.

9. A theft prevention system as recited in claim 1 further including a means for releasably securing said cover to said base, said means comprising:

at least one elongated bracket disposed within said housing and fixedly connected at one distal end thereof to said cover, and with the other distal end thereof being removably connected to said base, said removable connection including an elongated screw, said screw having a head and a threaded portion, with the threaded portion thereof passing through aligned apertures in said base and said other distal end of said bracket and threadably engaged with said other distal end, and with the head of said screw being disposed outside of said housing and with said screw being located relative to said base such that the threadable disengagement thereof, to permit the separation of said cover from said base, may only occur when said base is lifted from said planar resting surface.

10. A theft prevention system as recited in claim 9 wherein the length of said threaded portion of said screw, is greater than the spacing between said base and the head of said screw when said screw is in the fully seated position, said spacing being measured along the longitudinal axis of said screw, such that full disengagement of said screw from said bracket may only occur when said base is lifted from said planar resting surface.

11. A theft prevention system for use with a business machine, said business machine having a housing including a base, adapted to rest on a planar surface, and a removable cover, and wherein said base includes an aperture, said theft prevention system comprising:

alarm means disposed within said housing, said alarm means being capable of generating a warning signal;

first switch means operatively connected to said alarm means and including a spring biased plunger, said first switch means being disposed such that said plunger projects downwardly through said aperture provided in the base of said housing, said plunger being in abutting contact with said planar resting surface such that said plunger is biased into an upward inactive position whereby when said housing is lifted upwardly from said planar surface, said plunger is biased downwardly actuating said alarm means thereby generating a warning signal;

guard means associated with said first switch means, said guard means including an elongated protective sleeve with one distal end thereof fixedly connected to said planar surface and with the other distal end thereof projecting upwardly into said aperture of said base and surrounding said plunger whereby said plunger is shielded from manipulation; and means for releasably securing said cover to said base, said means including at least one elongated bracket disposed within said housing and fixedly connected at one distal end thereof to said cover, and with the other distal end thereof being removably connected to said base, said removable connection including an elongated screw said screw having a head and a threaded portion, with the threaded portion thereof passing through aligned apertures in said base and said other distal end of said bracket and threadably engaged with said other distal end, and with the head of said screw being disposed outside of said housing and with said screw being located relative to said base such that the threadable disengagement thereof, to permit the separation of said cover from said base, may only occur when said base is lifted from said planar resting surface.

12. A theft prevention system as recited in claim 11 wherein the length of said threaded portion of said screw, is greater than the spacing between said base and the head of said screw when said screw is in the fully seated position, said spacing being measured along the longitudinal axis of said screw, such that full disengagement of said screw from said bracket may only occur when said base is lifted from said planar resting surface.

13. A theft prevention system for use with a business machine, said business machine having a housing including a base, adapted to rest on a planar surface, and a removable cover, and wherein said base includes an aperture, said theft prevention system comprising:

alarm means disposed within said housing, said alarm means being capable of generating a warning signal;

first switch means operatively connected to said alarm means and including a spring biased plunger, said first switch means being disposed such that said plunger projects downwardly through said aperture provided in the base of said housing, said plunger being in abutting contact with said planar resting surface such that said plunger is biased into an upward inactive position whereby when said housing is lifted upwardly from said planar surface, said plunger is biased downwardly actuating said alarm means thereby generating a warning signal:

guard means associated with said first switch means, said guard means including an elongated protective sleeve with one distal end thereof fixedly connected to said planar surface and with the other distal end thereof projecting upwardly into said aperture of said base and surrounding said plunger whereby said plunger is shielded from manipulation;

second switch means operatively connected to said alarm means and affixed to said base, said second switch means including a spring biased member disposed in abutting contact with the upper inner surface of said cover thereby maintaining said spring biased member in an inactive position whereby when said cover is moved upwardly relative to said base, said spring biased member is biased upwardly actuating said alarm means thereby generating a warning signal; and means for releasably securing said cover to said base, said means including at least one elongated bracket disposed within said housing and fixedly connected at one distal end thereof to said cover, and with the other distal end thereof being removably connected to said base, said removable connection including an elongated screw, said screw having a head and a threaded portion, with the threaded portion thereof passing through aligned apertures in said base and said other distal end of said bracket and threadably engaged with said other distal end, and with the head of said screw being disposed outside of said housing and with said screw being located relative to said base such that the threadable disengagement thereof, to permit the separation of said cover from said base, may only occur when said base is lifted from said planar resting surface.

14. A theft prevention system as recited in claim 13 wherein the length of said threaded portion of said screw, is greater than the spacing between said base and the head of said screw when said screw is in the fully seated position, said spacing being measured along the longitudinal axis of said screw, such that full disengagement of said screw from said bracket may only occur when said base is lifted from said planar resting surface.

* * * * *